US009840819B2

(12) United States Patent
Hopfensperger et al.

(10) Patent No.: US 9,840,819 B2
(45) Date of Patent: Dec. 12, 2017

(54) INTERLOCK ARRANGEMENT FOR POWERED DEVICES

(71) Applicant: Monroe Truck Equipment, Inc., Monroe, WI (US)

(72) Inventors: Alex J. Hopfensperger, Monroe, WI (US); Andrew Holverson, Monroe, WI (US)

(73) Assignee: Monroe Truck Equipment, Inc., Monroe, WI (US)

( * ) Notice: Subject to any disclaimer, the term of this patent is extended or adjusted under 35 U.S.C. 154(b) by 269 days.

(21) Appl. No.: 14/848,508

(22) Filed: Sep. 9, 2015

(65) Prior Publication Data

US 2017/0066484 A1 Mar. 9, 2017

(51) Int. Cl.
*B60L 1/00* (2006.01)
*E01H 10/00* (2006.01)

(52) U.S. Cl.
CPC ..... *E01H 10/007* (2013.01)

(58) Field of Classification Search
CPC ..... E05D 15/165; E05D 15/248; E05D 15/44; E05D 13/003
USPC ..... 307/10.1, 10.3, 10.6, 326, 328, 96, 97, 307/650, 652, 112, 116–124, 149; 172/819, 811; 242/389
See application file for complete search history.

(56) References Cited

U.S. PATENT DOCUMENTS 3,530,696 A 3/1968 Dunmire
4,111,475 A 9/1978 McCormick et al.
4,179,999 A 12/1979 Cotten
5,171,155 A 12/1992 Mendoza
5,244,101 A 9/1993 Palmer et al.
5,918,488 A 7/1999 Deeter
5,924,315 A 7/1999 Chang
6,123,276 A 9/2000 Ungerer et al.
6,206,073 B1 3/2001 Lay
6,523,730 B2 2/2003 Anderson
6,641,185 B2 11/2003 Hale et al.
7,037,034 B2 5/2006 Dillingham
7,204,508 B1 4/2007 Hsai
8,505,838 B2 8/2013 Schaefer et al.
8,690,201 B2 4/2014 Frazier
8,708,378 B2 4/2014 Frazier
2012/0024551 A1* 2/2012 Holverson ..... E02F 3/7627 172/819
2014/0159384 A1 6/2014 Frazier
(Continued)

*Primary Examiner* — Thomas Skibinski
(74) *Attorney, Agent, or Firm* — Quarles & Brady LLP

(57) ABSTRACT

Embodiments of the invention provide an interlock arrangement with a blocking feature and a locking feature secured to an interlock member. The interlock member can move between first and second interlock orientations. With the interlock member in the first interlock orientation, the blocking feature can prevent attachment of a power conduit to a power connection, such that the motor is not enabled to power a powered device, and the first locking feature can allow a first gate to open in order to provide access to the powered device. With the interlock member in the second interlock orientation, the blocking feature can allow attachment of the power conduit to the power connection, such that the motor is enabled to power the powered device, and the first locking feature can prevent the first gate from opening such that the first gate obstructs access to the powered device.

20 Claims, 9 Drawing Sheets

(56) References Cited

U.S. PATENT DOCUMENTS

| | | | | |
|---|---|---|---|---|
| 2014/0326472 | A1* | 11/2014 | Holverson | E02F 3/7627<br>172/819 |
| 2015/0266698 | A1* | 9/2015 | Holverson | B65H 75/4486<br>242/389 |
| 2017/0022741 | A1* | 1/2017 | Holverson | E05D 15/165 |

* cited by examiner

FIG. 4A
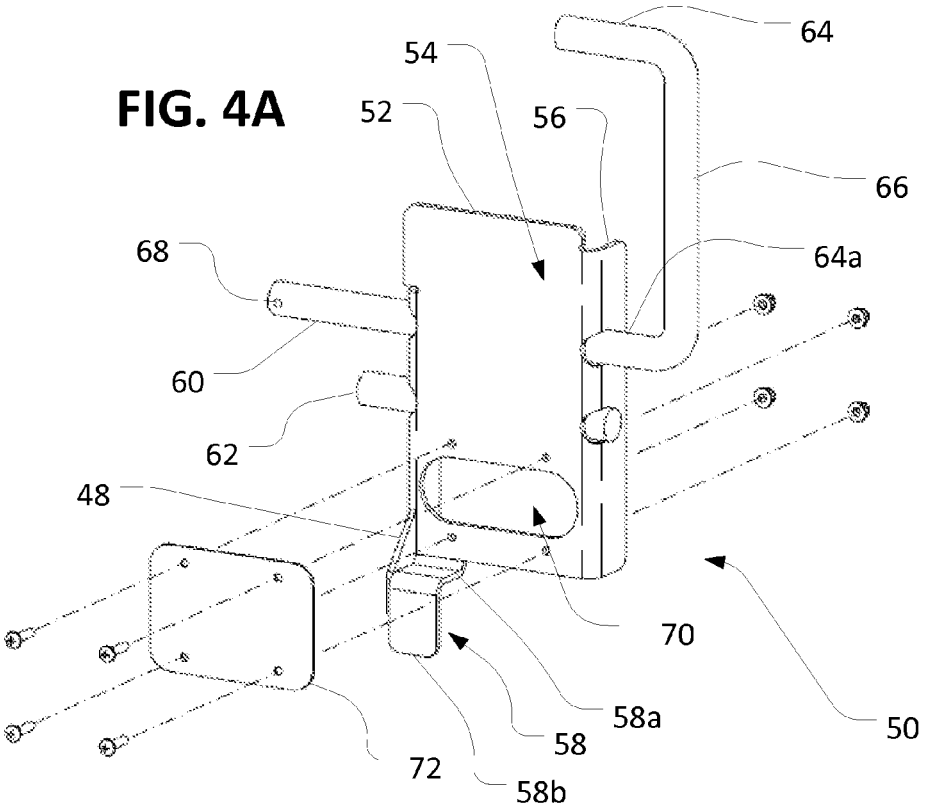
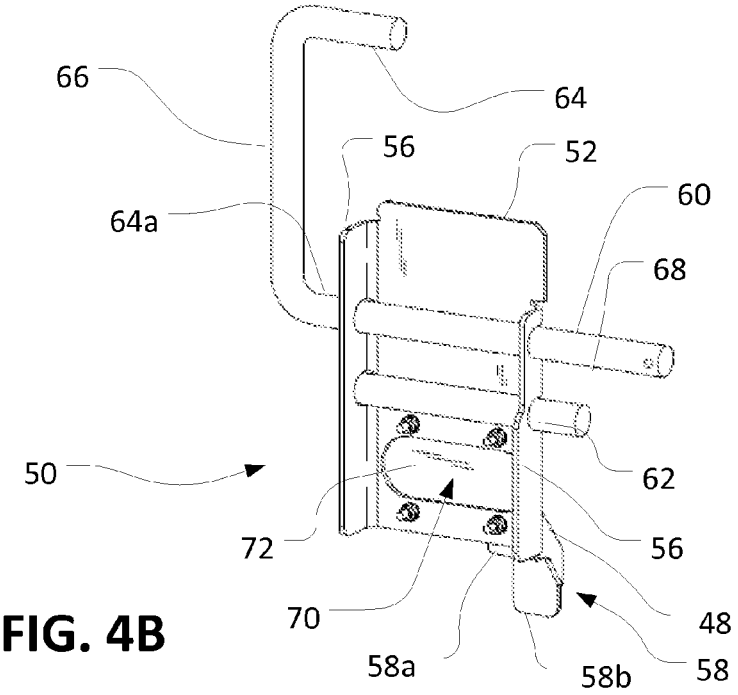
FIG. 4B

FIG. 7A
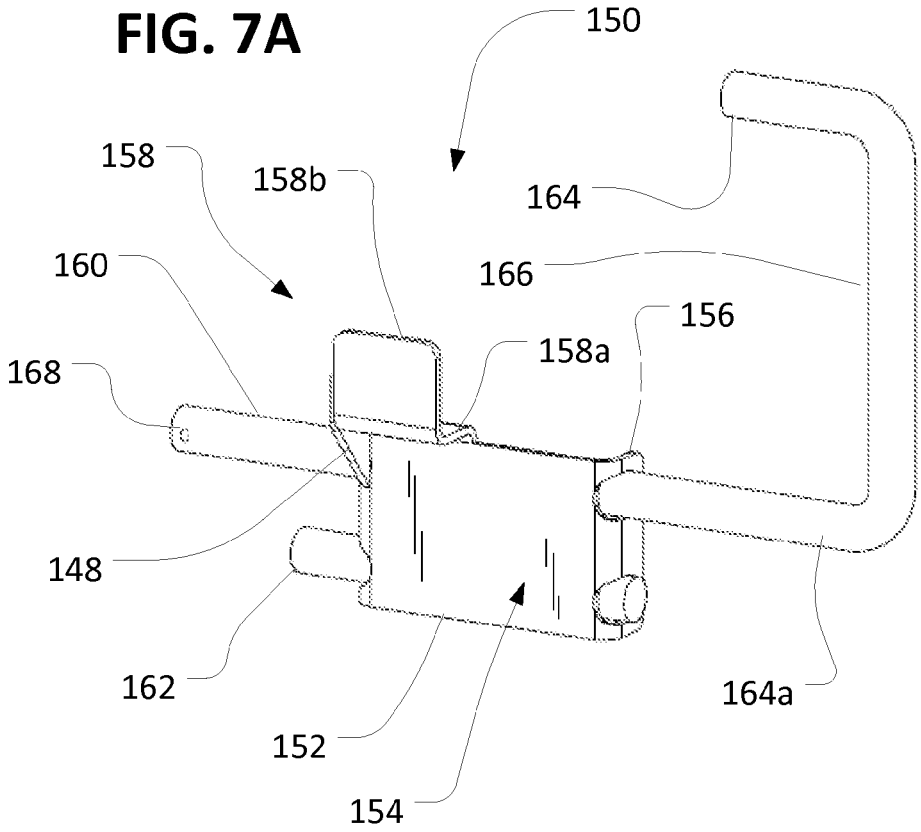
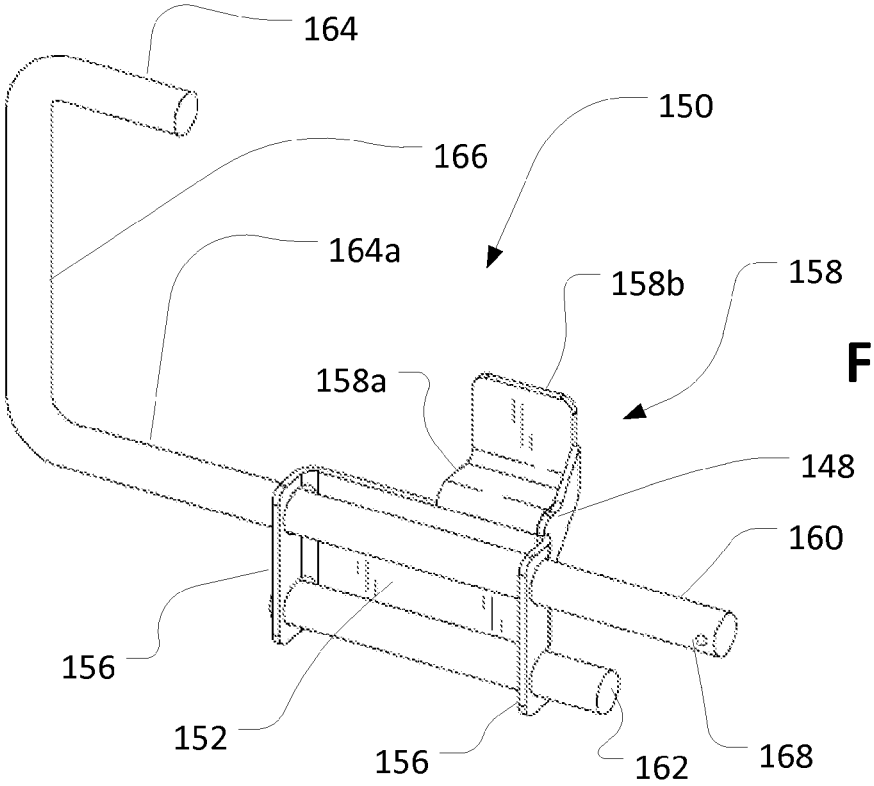
FIG. 7B

INTERLOCK ARRANGEMENT FOR POWERED DEVICES

BACKGROUND

Powered devices, such as powered augers, can be usefully employed in a variety of operations. For example, in a vehicle for distributing salt for deicing, a powered auger in a rear trough of the vehicle can be configured to rotate, in order to process salt from a bed of the vehicle and distribute the salt onto a road surface.

To avoid adverse contacts with powered devices during active operation (or otherwise), it can be useful to enclose the powered devices to varying degrees. However, various devices, including augers, can require cleaning, repair, and other maintenance, which can require that an operator be able to physically access the devices. As such, it may be useful to enclose powered devices with gates that can be opened and closed. For example, for an auger for salt distribution, one or more panel-like gates can be provided at a rear of the relevant vehicle near the auger. In order to perform maintenance on the auger, an operator can move the gates to open orientations, thereby providing access to the auger for manual cleaning and repair. The gates can then be moved to closed orientations in order to block access to the auger during auger operation.

For various reasons, it can be useful to regulate operation of powered devices, such as powered augers, such that the devices do not receive power while an operator has access to the devices, including when one or more gates are open. Generally, interlock arrangements of various types can be useful for this purpose.

SUMMARY

Some embodiments of the disclosure can be used with a vehicle with a frame, a power connection in communication with a motor, a powered device configured to be powered by the motor and at least partly enclosed by one or more gates, wherein a power conduit is configured to attach to the power connection to power the motor for powering of the powered device, and to detach from the power connection to prevent powering of the motor via the power conduit.

In one embodiment of the disclosure, a blocking feature and a first locking feature can be secured to an interlock member configured to slide between first and second interlock orientations. With the interlock member in the first interlock orientation, the blocking feature can prevent attachment of the power conduit to the power connection, such that the motor is not enabled to power the powered device, and the first locking feature can allow a first of the gates to open in order to provide access to the powered device. With the interlock member in the second interlock orientation, the blocking feature can allow attachment of the power conduit to the power connection, such that the motor is enabled to power the powered device, and the first locking feature can prevent the first gate from opening such that the first gate obstructs access to the powered device.

In another embodiment of the disclosure, an interlock body can include a cover plate, a blocking feature secured to the cover plate, first and second locking pins secured to the cover plate, and a first guide feature secured to the cover plate and engaging a second guide feature secured to the frame. The interlock body can move between first and second interlock orientations, as guided by the first and second guide features. With the interlock body in the first interlock orientation, the blocking feature can prevent attachment of the power conduit to the power connection, such that the motor is not enabled to power the powered device with power received via the power conduit, and the first and second locking pins can allow first and second of the gates, respectively, to open in order to provide access to the powered device. With the interlock body in the second interlock orientation, the blocking feature can allow attachment of the power conduit to the hydraulic connection, such that the motor is enabled to power the powered device with power received via the power conduit, and the first and second locking pins can allow the first and second gates, respectively, to open in order to provide access to the powered device.

In still another embodiment of the disclosure, an interlock body can include a cover plate, a blocking projection secured to and extending away from the cover plate, first and second locking pins secured to the cover plate, and a guide pin secured to the cover plate and extending at least partly through a guide hole in a guide feature secured to the frame. The interlock body can move between first and second interlock orientations, as guided by movement of the guide pin within the guide hole. With the interlock body in the first interlock orientation, the blocking projection can be in blocking alignment with the power connection to prevent attachment of the power conduit to the power connection, such that the motor is not enabled to power the rotation of the powered auger with power received via the power conduit, and the first and second locking pins can allow first and second of the gates, respectively, to open in order to provide access to the powered auger. With the interlock body in the second interlock orientation, the blocking projection can be out of blocking alignment with the power connection to allow attachment of the power conduit to the power connection, such that the motor is enabled to power the rotation of the powered auger with power received via the power conduit, and the first and second locking pins can physically obstruct the first and second gates, respectively, to prevent the first and second gates from opening, such that the first and second gates obstruct access to the powered auger.

BRIEF DESCRIPTION OF THE DRAWINGS

The accompanying drawings, which are incorporated in and form a part of this specification, illustrate embodiments of the invention and, together with the description, serve to explain the principles of embodiments of the disclosure:

FIG. 4A is a front perspective view of an interlock body of the interlock arrangement of FIG. 1, with a cover shown exploded away from a cover plate of the interlock body;

FIG. 4B is a rear perspective view of the interlock body of FIG. 4A, with the cover shown attached to the cover plate;

FIG. 7A is a front perspective view of an interlock body of the interlock arrangement of FIG. 6;

FIG. 7B is a rear perspective view of the interlock body of FIG. 7A.

DETAILED DESCRIPTION

Figure 1:
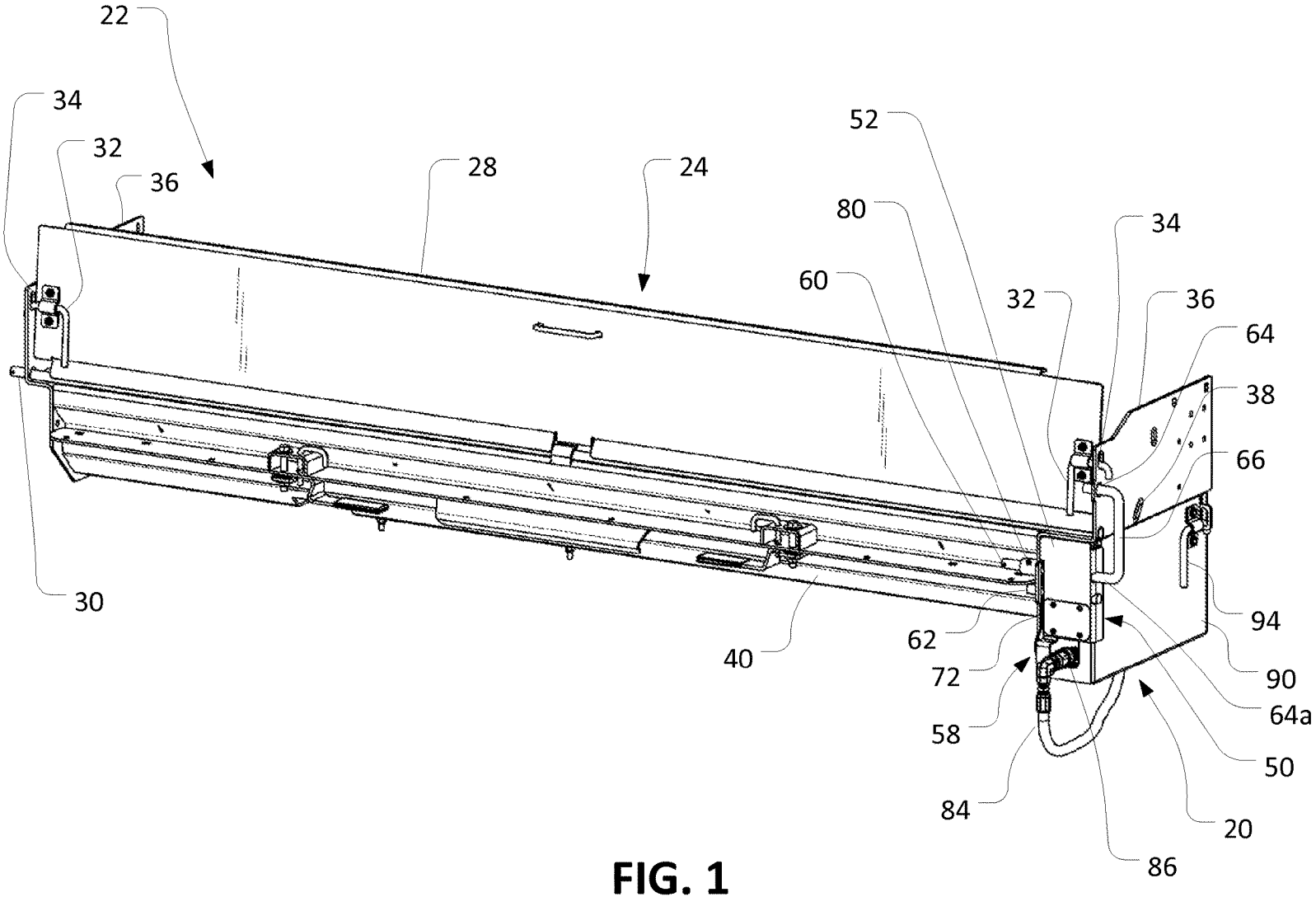
FIG. 1 is a rear, right perspective view of an auger system for a vehicle with an interlock arrangement according to one embodiment of the disclosure, with the interlock arrangement in a closed orientation.

Before any embodiments of the invention are explained in detail, it is to be understood that the invention is not limited in its application to the details of construction and the arrangement of components set forth in the following description or illustrated in the various drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Likewise, "at least one of A, B, and C," and the like, is meant to indicate A, or B, or C, or any combination of A, B, and/or C. Unless specified or limited otherwise, the terms "mounted," "secured," "connected," "supported," and "coupled" and variations thereof are used broadly and encompass both direct and indirect mountings, connections, supports, and couplings, including integral formation. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

As noted above, it may be useful to ensure that a powered device, such as an auger, does not receive power while an operator is physically accessing the device. The interlock arrangement disclosed herein can provide such a benefit, among others.

As discussed in greater detail below, some embodiments of the disclosed interlock arrangement can be used with a vehicle that includes a powered device, such as an auger, one or more gates for selectively allowing or obstructing access to the powered device, a motor for powering the powered device, a power connection, such a hydraulic quick-connect fitting, for delivering power to the motor, and a power conduit, such as a hydraulic line, for delivering power to the power connection. When the power conduit is connected to the power connection, power (e.g., hydraulic power) can flow to the motor via the power conduit, such that the motor can power the powered device. When the power conduit is disconnected from the power connection, power cannot flow to the motor via the power conduit, such that the motor cannot power the powered device (at least with power from the power conduit).

An interlock member, such as a contoured metal cover plate, can be configured to move between open and closed orientations, as guided by a guide feature, such as a bushing, gusset, or track secured to a frame of the vehicle. A blocking feature, such as a metal projection, can be secured to the interlock member, as can one or more locking features, such as metal locking pins.

When the interlock member is moved to the open orientation, the blocking feature can prevent connection of the power conduit to the power connection, such that power cannot flow to the motor via the power conduit and the power connection. For example, with the blocking feature configured as a projection, moving the interlock member to the open orientation can move the projection into blocking alignment with the power connection, such that the projection physically prevents attachment of the power conduit to the power connection. Similarly, when the power conduit is attached to the power connection, it may not be possible to move the interlock member into the open orientation because movement of the projection into the blocking alignment may be physically prevented by the power conduit (as attached to the power connection). In this way, when the interlock member (and the interlock arrangement, generally) is in the open orientation, the motor and the powered device cannot be powered via the power conduit. Further, when the interlock member (and the interlock arrangement, generally) is in the closed orientation, it may not be possible to move the interlock member to the open orientation without detaching the power conduit from the power connection.

Other features can also be secured to the interlock member, in order to regulate access to the powered device. For example, one or more locking features, such as locking pins, can also be secured to the interlock member. Each locking feature can be configured to prevent the opening of a respective gate for access to the powered device when the interlock member is in the closed orientation, while allowing the opening of the respective gate when the interlock member is in the open orientation. In this way, for example, the locking features can ensure that relevant gates obstruct access to the powered device when the powered device can receive power from the motor (e.g., when the power conduit is connected or can be connected to the power connection), while allowing the gates to open when the powered device cannot receive power from the motor (e.g., when the power conduit is not connected and cannot be connected to the power connection).

In some embodiments, the disclosed interlock arrangement can also regulate access to other areas of the relevant system. For example, where a transmission assembly, such as a chain drive, is used to transmit power from the motor to the powered device, a shield can be provided that at least partly covers the transmission assembly. When the interlock member is in the open orientation, the interlock arrangement can allow the shield to be opened, such that an operator can access the transmission assembly for cleaning, repair, or other maintenance. However, when the interlock member is in the closed orientation, the interlock arrangement can block the shield from opening, such that access to the transmission assembly may be prevented.

Figure 2:
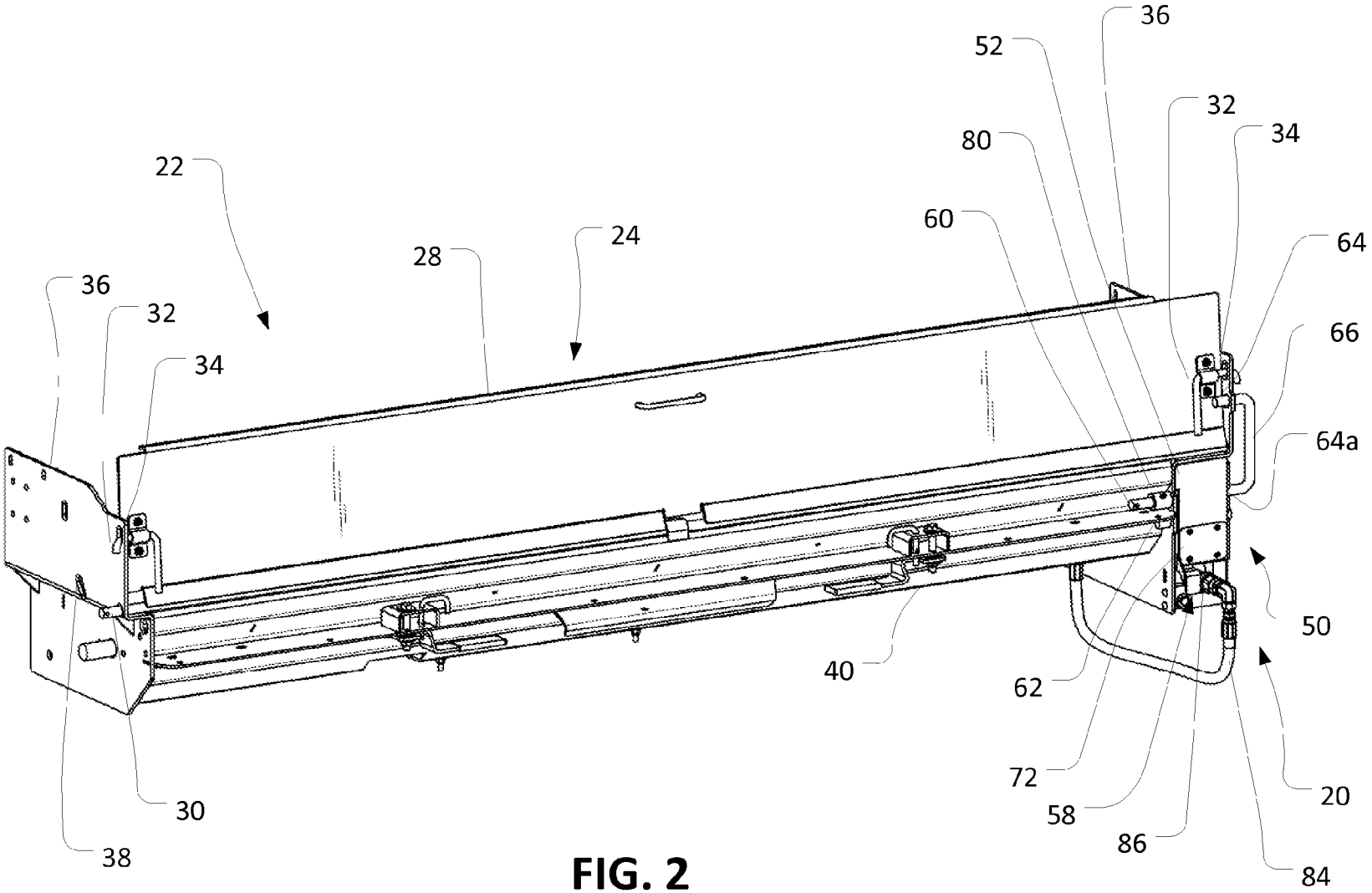
FIG. 2 is a rear, left perspective view of the auger system and interlock arrangement of FIG. 1, also with the interlock arrangement in the closed orientation.
Figure 3:
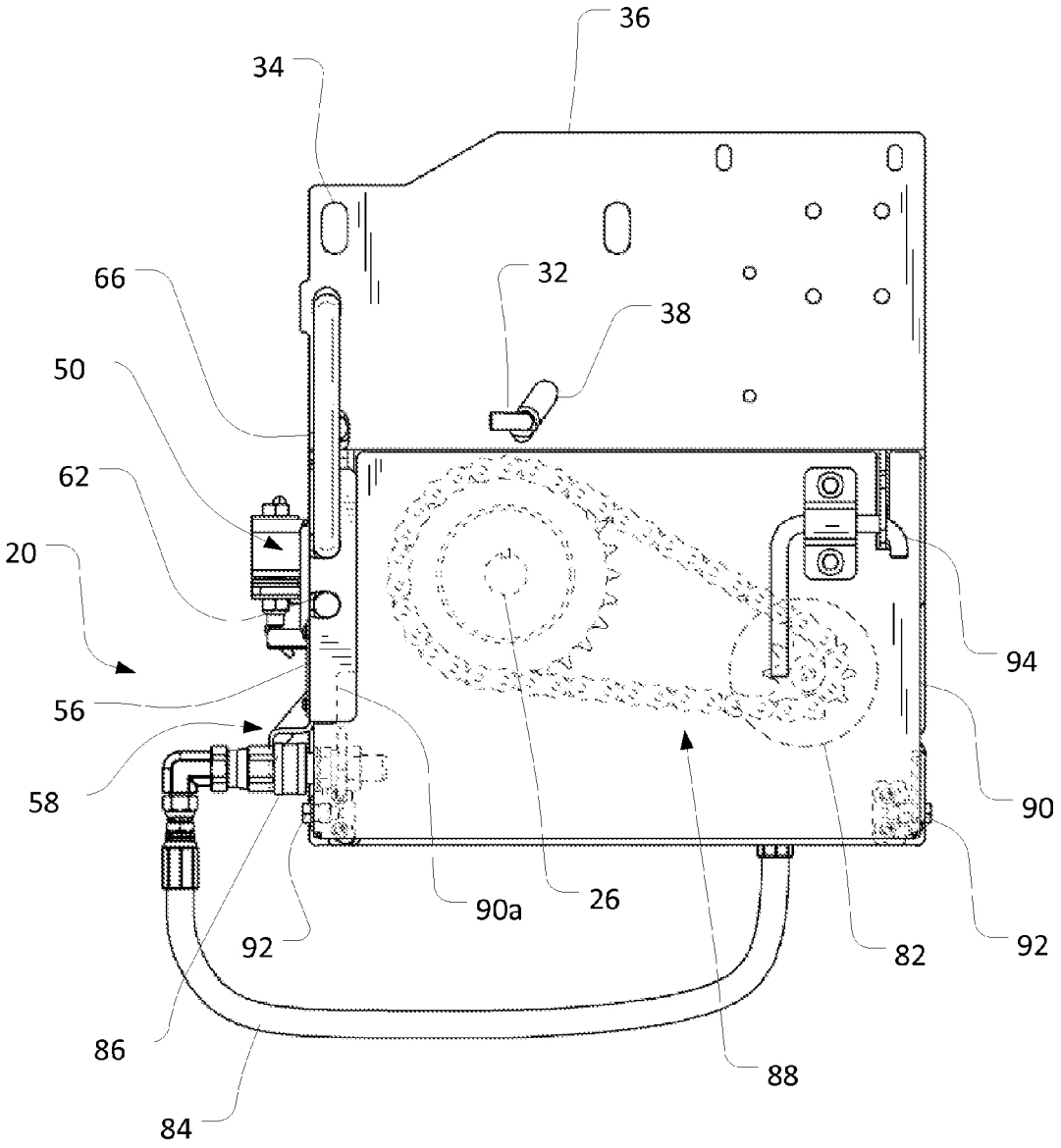
FIG. 3 is a right elevational view of the auger system and interlock arrangement of FIG. 1, with a chain guard in a closed orientation and with certain internal components shown with dotted lines.

FIGS. 1 through 3 illustrate an example interlock arrangement 20, for use with a salt-distributing system 22 for a vehicle (not shown). It will be understood that the interlock arrangement 20 and the salt-distributing system 22 are presented as examples only, and that the interlock arrangement 20 (or others) can also be used with other systems for various vehicles, including other material-distributing systems or systems for powered movement of various devices.

In the arrangement depicted in FIGS. 1 through 3, the salt-distributing system 22 includes a trough 24 which can be disposed at the rear of a relevant vehicle (not shown). An auger 26 (see, e.g., FIG. 5B) can be disposed within the trough 24, in order to process and distribute salt received from a bed (not shown) of the vehicle.

An upper gate 28 for the auger 26 can be configured to pivot about a pivot 30, such that the upper gate 28 can be manually moved between various orientations. For example, the upper gate 28 can be moved to a upright, closed orientation, as depicted in FIGS. 1 and 2, in which the upper gate 28 allows salt from the vehicle bed to flow into the trough 24 for processing by the auger 26, but generally obstructs access to the auger 26 from the rear of the vehicle. The upper gate 28 can also be moved to a laid-down, closed orientation, as depicted in FIG. 3, in which the upper gate 28 covers the trough 24, thereby obstructing access to the auger 26 from above while also generally preventing salt from entering the trough 24 from the vehicle bed. This configuration can be useful, for example, in order to allow salt to be dumped out of the vehicle bed without the salt entering the trough 24. The upper gate 28 can also be moved to an open orientation, as depicted in FIG. 5B, in which the upper gate 28 can permit access to the auger 26 from the rear of the vehicle. In other embodiments, other types of gates can be used, including gates that open via non-pivoting movement (e.g., sliding gates).

In some embodiments, latches 32 on the upper gate 28 can be configured to generally secure the upper gate 28 in a particular orientation. For example, with the upper gate 28 in the upright, closed orientation of FIGS. 1 and 2, the latches 32 can engage slots 34 on side panels 36 to hold the upper gate 28 in place. Similarly, with the upper gate 28 in the laid-down, closed orientation of FIG. 3, the latches 32 can engage slots 38 on the side panels 36 to hold the upper gate 28 in place. Because the latches 32 can be removed from the slots 38 or 34 relatively easily, however, the latches 32 may not necessarily prevent access to the trough 24 and the auger 26 while the auger 26 is operating or otherwise receiving power.

A lower gate 40 for the auger 26 can also be configured to pivot between various orientations. For example, the lower gate 40 can be moved to a closed orientation, as depicted in FIGS. 1 through 3, in which the lower gate 40 obstructs access to the auger 26 from below, while also preventing material (e.g., salt) from exiting the auger 26 via the opening blocked by the lower gate 32. The lower gate 40 can also be moved to an open orientation, as depicted in FIG. 5B, in which the lower gate 40 can permit access to the auger 26 from below. In some embodiments, latches (not shown) similar to the latches 32 (or otherwise configured) can be provided for the lower gate 40.

Referring also to FIGS. 4A and 4B, an interlock body 50 for the interlock arrangement 20 can include an interlock member such as a contoured metal cover plate 52. The cover plate 52 can include a front face 54, with side flanges 56 extending away from the front face 54 at either side of the front face 54. (It will be noted that the interlock body 50 can be installed in the interlock arrangement 20 with the front face 54 facing rearwards, relative to the vehicle.) The flanges 56 can be integrally formed with the cover plate 52, or can be otherwise secured to cover plate 52.

The interlock body 50 can also include a blocking feature, such as a blocking projection 58, secured to the cover plate 52. The blocking projection 58 can be integrally formed with the cover plate 52, or can be otherwise secured to the cover plate 52 (e.g., via welding). As depicted, the blocking projection 58 includes a spacing portion 58*a* extending generally perpendicularly away from the front face 54, with a blocking portion 58*b* extending generally perpendicularly away from the spacing portion 58*a* and generally in parallel with the front face 54. Also as depicted, the blocking projection 58 is strengthened by the inclusion of a gusset 48 between the blocking projection 58 and the front face 54 of the cover plate 52. In other embodiments, other configurations for a blocking projection, or blocking feature generally, are possible.

The interlock body 50 can also include a guide feature, such as a guide pin 60, and various locking features, such as upper and lower locking pins 62 and 64. The guide pin 60 and locking pins 62 and 64 (or other guide or locking features) can be secured to the interlock body 50 in various ways. In the embodiment depicted, for example, the guide pin 60 and the lower locking pin 62 extend through and are secured (e.g., welded) to one of the side flanges 56, while the lower locking pin 62 and an extension 64*a* of the upper locking pin 64 extend through and are secured to the other of the side flanges 56. Also in the embodiment depicted, the guide pin 60 is integrally formed with the upper locking pin 64 in order to form a handle portion 66. In other embodiments, other handles (or no handles) can be included. Likewise, in other embodiments, the various guide and locking pins 60, 62, and 64 can be integrally formed with, or otherwise attached to, each other in various ways or not at all. A hole 68 for a cotter pin (not shown) or other device to secure the guide pin 60 with respect to the system 22 can also be included. In other embodiments, other configurations of the various guide and locking features are possible, including, for example, guide features for the interlock body 50 that are configured to engage corresponding guide tracks (or other guide features) secured to the salt-distributing system 22.

In some embodiments, an opening 70 can be provided in the front face 54 of the cover plate 52. This may be useful, for example, in order to allow an internal feature or device of the interlock arrangement 20 or salt-distributing system 22 to extend through the cover plate 52, while still allowing the interlock body 50 to move between different orientations. For example, the opening 70 can be configured to accommodate a portion of a gear box (not shown) or other transmission assembly of the salt-distributing system 22. A cover 72 can be provided for the opening 70, with the cover 72 configured to removably attach to the interlock body 50 in various ways (e.g., via screws, as depicted in FIGS. 4A and 4B).

Figure 5A:
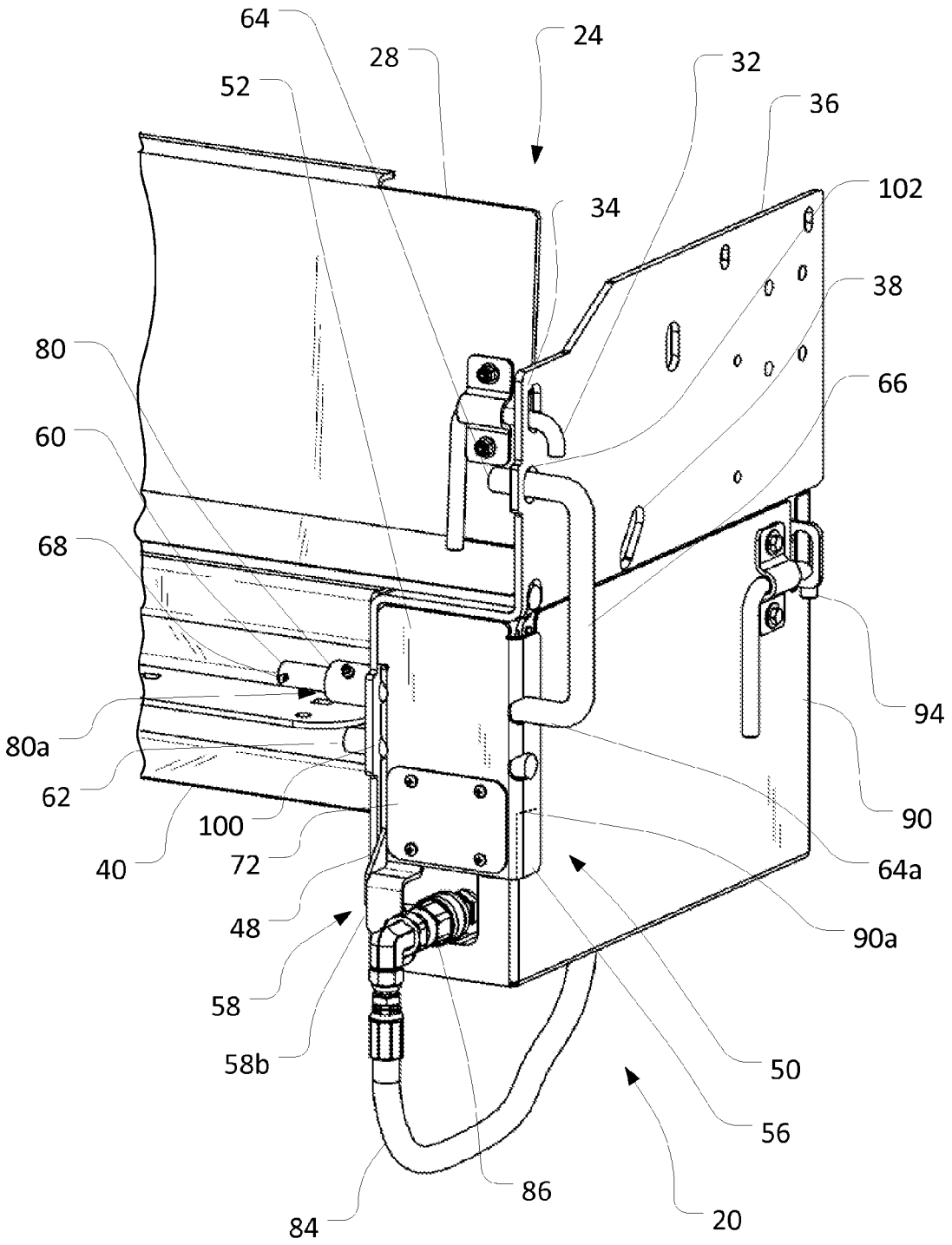
FIG. 5A is an enlarged rear, right perspective of the auger system and interlock arrangement of FIG. 1, with the interlock arrangement in the closed orientation.
Figure 5B:
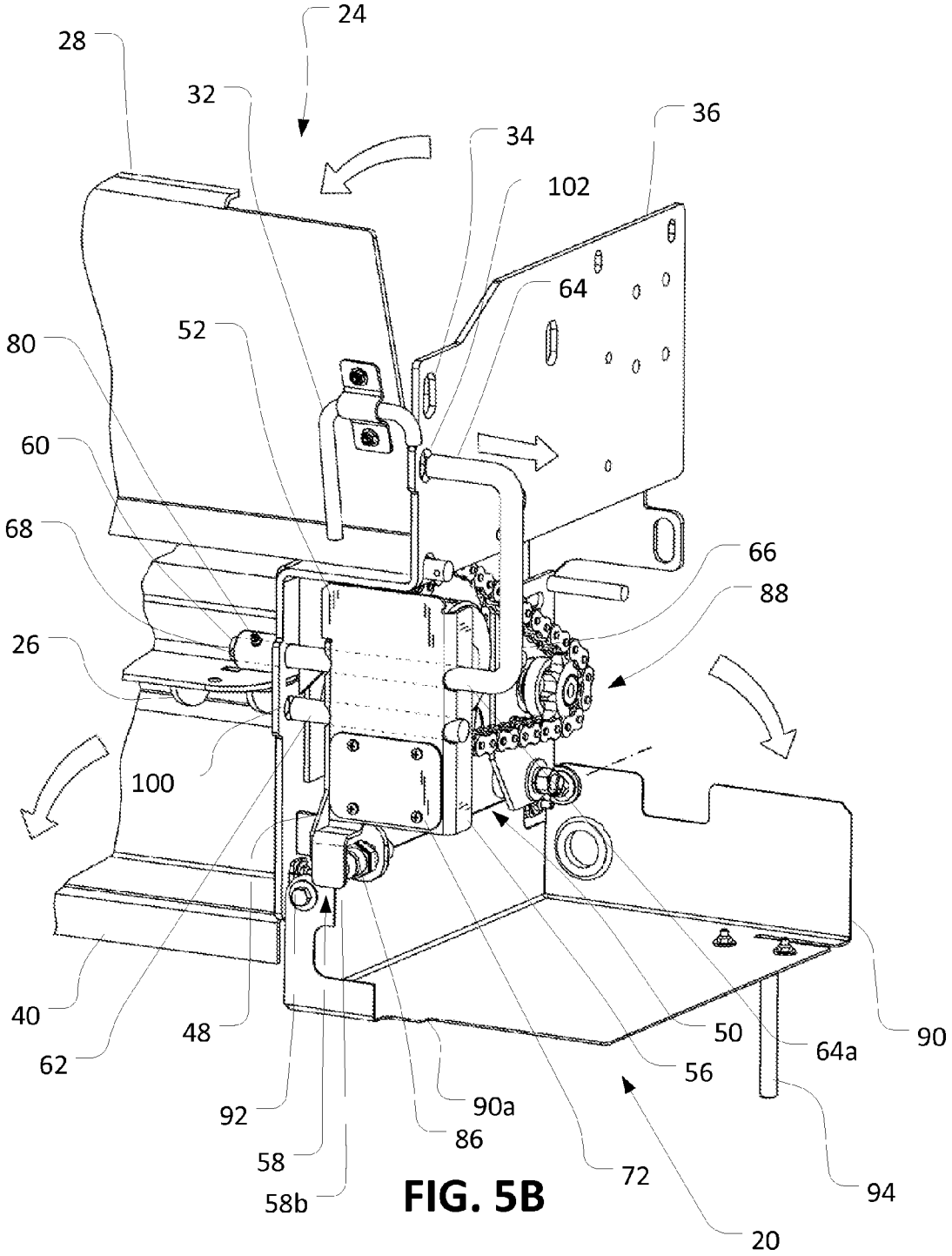
FIG. 5B is an enlarged rear, right perspective of the auger system and interlock arrangement of FIG. 1, with the interlock arrangement in an open orientation.

Referring again to FIGS. 1 through 3, the interlock body 50 can be secured to the salt-distributing system 22 with the guide pin 60 extending through a guide hole 80*a* of a guide bushing 80 (see FIG. 5A for guide hole 80*a*). In this way, as also discussed below, the interlock body 50 can be moved between open and closed orientations, as guided by sliding movement of the guide pin 60 within the guide bushing 80. In other embodiments, other means of securing the interlock body 50 to the salt-distributing system 22 can be used, as can other means of guiding movement of the interlock body 50. For example, a track (not shown) can be provided on the salt-distributing system 22, with the interlock body 50 configured to engage and slide along the track between open and closed orientations.

Still referring to FIGS. 1 through 3, the salt-distributing system 22 can further include a motor 82 (see FIG. 3), configured to power rotation of the auger 26. As depicted, the motor 82 is configured as a hydraulic motor, which can be powered by pressurized hydraulic fluid received via a hydraulic power conduit 84. In order to transmit the pressurized fluid to the motor 82, the power conduit 84 can be connected to a hydraulic power connection 86 (e.g., a quick-connect hydraulic fitting). Conversely, when the power conduit 84 is disconnected from the power connection 86, hydraulic fluid cannot flow from the power conduit 84 to the motor 82 and the motor cannot operate (at least using power from the power conduit 84).

In some embodiments, other types of motors or power sources can be used. For example, a motor for the auger 26 can be configured as an electrical motor, which may operate using electrical power received from an electrical power conduit (e.g., configured similarly to the hydraulic power conduit 84). In such a case, an appropriate (e.g., alternative) power connection to the power connection 86 can be used. For example, a quick-connect (or other) electrical connection may be provided, such that the electrical motor can operate when the relevant power conduit is connected to the electrical connection, but cannot operate (at least with power from the power conduit) when the power conduit is disconnected from the electrical connection.

In some embodiments, a transmission assembly can be provided, in order to convert relatively high speed rotation from an output of a motor into relatively low speed rotation at the auger 26 (or otherwise modulate speed between motor and auger). In some embodiments, a shield can be provided for such a transmission assembly (or other components). For example, as can be seen in particular in FIG. 3, a transmission assembly configured as a chain drive 88 can be configured to convert relatively high speed rotation from an output of the motor 82 into relatively low speed rotation at the auger 26. Further, a shield 90 can be provided that can pivot upward about pivots 92 to a closed orientation and can pivot downwards about the pivots 92 to an open orientation (see, e.g., FIG. 5B). With the shield 90 in the closed orientation, the shield 90 can obstruct access to the chain drive 88 (and other components). A latch 94, similar to the latches 32 can also be provided, in order to secure the shield 90 in the closed orientation. As with the latches 32, however, because the latch 94 can be relatively easily unhooked, the latch 94 may not necessarily prevent access to the chain drive 88 while the chain drive 88 (and the auger 26) is operating or otherwise receiving power.

Referring also to FIG. 5A, when the interlock arrangement 20 is in a closed orientation, the interlock body 50 can prevent the upper and lower gates 28 and 40 and the shield 90 from opening, such that access to the trough 24 and the auger 26 (not shown in FIG. 5A) can be obstructed. When the interlock arrangement 20 is in the closed orientation, the blocking portion 58*b* of the blocking projection 58 is disposed out of blocking alignment with the power connection 86. Accordingly, the blocking projection 58 does not prevent an operator from connecting the power conduit 84 to the power connection 86 and thereby powering the motor 82 (not shown in FIG. 5A) and the auger 26. Also with the blocking projection 58 thus disposed, the lower locking pin 62 extends through a lower locking hole 100, such that the locking pin 62 blocks the lower gate 28 from pivoting outward and downward to open. Further, the upper locking pin 64 extends through an upper locking hole 102, such that the upper locking pin 64 blocks the upper gate from pivoting outward and downward to open. Accordingly, with the blocking projection 58 disposed to allow the power to flow from the power conduit 84 through the power connection 86 to the motor 82, the locking pins 62 and 64 can prevent the gates 40 and 28 from opening, and thereby obstruct access to the powered auger 26 by an operator.

With the interlock arrangement 20 in the closed orientation depicted in FIG. 5A, the interlock body 50 can also prevent the shield 90 for the chain drive 88 (not shown in FIG. 5A) from opening. In the embodiment depicted, for example, when the interlock body 50 is in the closed orientation, the shoulder 90*a* of the shield is partly covered by the outboard side flange 56 of the interlock body 50, such that the flange 56 prevents the shield 90 from pivoting outward and downward to open. Accordingly, with the blocking projection 58 disposed to allow the power to flow from the power conduit 84 through the power connection 86 to the motor 82 and the chain drive 88, the flange 56 of the interlock body 50 prevents the shield 90 from opening, and thereby obstructs access to the chain drive 88 by an operator.

In order for an operator to access the auger 26, the chain drive 88, and other internal components, the operator can move the interlock arrangement 20 from the closed orientation depicted in FIG. 5A to the open orientation depicted in FIG. 5B. As illustrated by a block arrow, for example, the operator may use the handle 66 to move the interlock body 50 (generally to the right, as depicted in FIG. 5B), as guided by the movement of the guide pin 60 within the guide bushing 80. In some embodiments, a stop feature, such as a cotter pin (not shown) inserted through the hole 68) or another component, can prevent the guide pin 60 from being fully withdrawn from the guide bushing 80 or can otherwise define a limit to the movement of the interlock body 50. With the interlock body 50 moved appropriately far to the right (as depicted), the locking pins 62 and 64 can be withdrawn from (or at least translated sufficiently within) the respective locking holes 100 and 102, such that the locking pins 62 and 64 no longer prevent the lower and upper gates 40 and 28 from pivoting open (as also illustrated by block arrows). Additionally, movement of the flange 56 along with the interlock body 50 can release the shoulder 90*a* of the shield 90, such that the shield 90 can pivot open (as also illustrated by a block arrow).

At the same time, the movement of the interlock body 50 to release the gates 40 and 28 and the shield 90 can also move the blocking portion 58*b* of the blocking projection 58 into blocking alignment with the power connection 86. Where, as depicted, the power conduit 84 (not shown in FIG. 5B) has been detached from the power connection 86, the blocking projection 58 can be moved fully into blocking alignment with the power connection 86 to generally block re-attachment of the power conduit 84 to the power connection 86. Accordingly, so long as the locking pins 62 and 64 do not prevent the opening of the gates 40 and 28 and the flange 56 does not prevent the opening of the shield 90, the power conduit 84 cannot be re-attached to the power connection and the motor 82 (not shown in FIG. 5B), chain drive 88, and auger 26 cannot be powered via power from the power conduit 84. Further, when an operator attempts to move the interlock arrangement 20 from the closed orientation to the open orientation with the power conduit 84 still attached to the power connection 86, the power conduit 84 can block movement of interlock body 50 into blocking alignment, via interaction of the power conduit 84 with the blocking projection 58, such that the gates 40 and 28 and the shield 90 cannot be opened.

Figure 6:
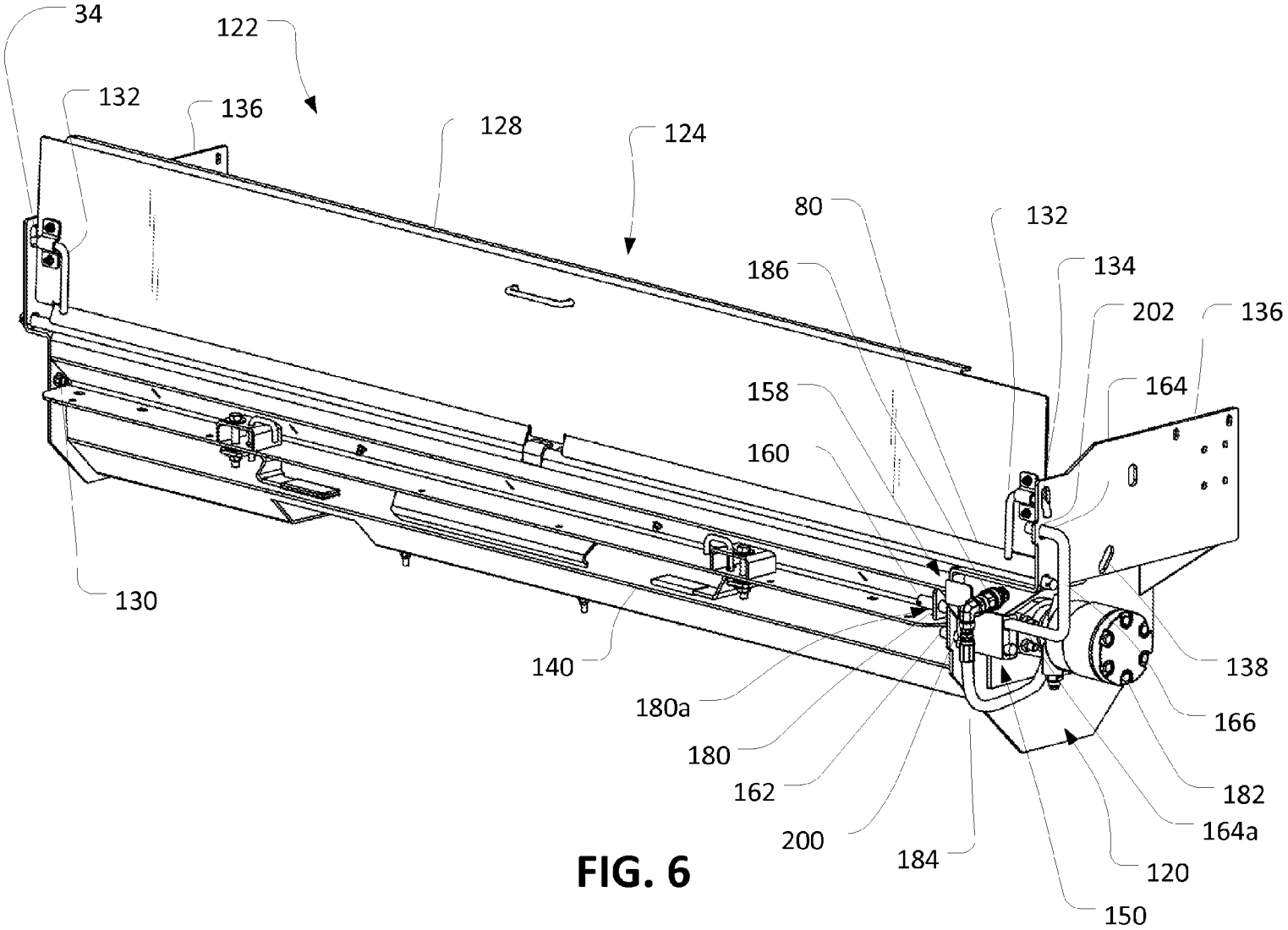
FIG. 6 is a rear, right perspective view of another auger system for a vehicle and an interlock arrangement according to another embodiment of the disclosure, with the interlock arrangement in a closed orientation.

In other embodiments, other configurations are possible. FIG. 6, for example, illustrates another example interlock arrangement 120 for a salt-distributing system 122. In various ways, the interlock arrangement 120 and salt-distributing system 122 are similar to the interlock arrangement 20 and salt-distributing system 22, with certain differences highlighted in the discussion below. Again, it will be understood that the interlock arrangement 120 and the salt-distributing system 122 are presented as examples only, and that the interlock arrangement 120 (or others) can also be used with other systems for various vehicles, including other material-distributing systems or systems for powered movement of various other devices.

In the arrangement depicted in FIG. 6, the salt-distributing system 122 includes a trough 124 which can be disposed at the rear of a relevant vehicle (not shown). An auger 126 (see, e.g., FIG. 8) can be disposed within the trough 124, in order to process and distribute salt received from a bed (not shown) of the vehicle.

Figure 8:
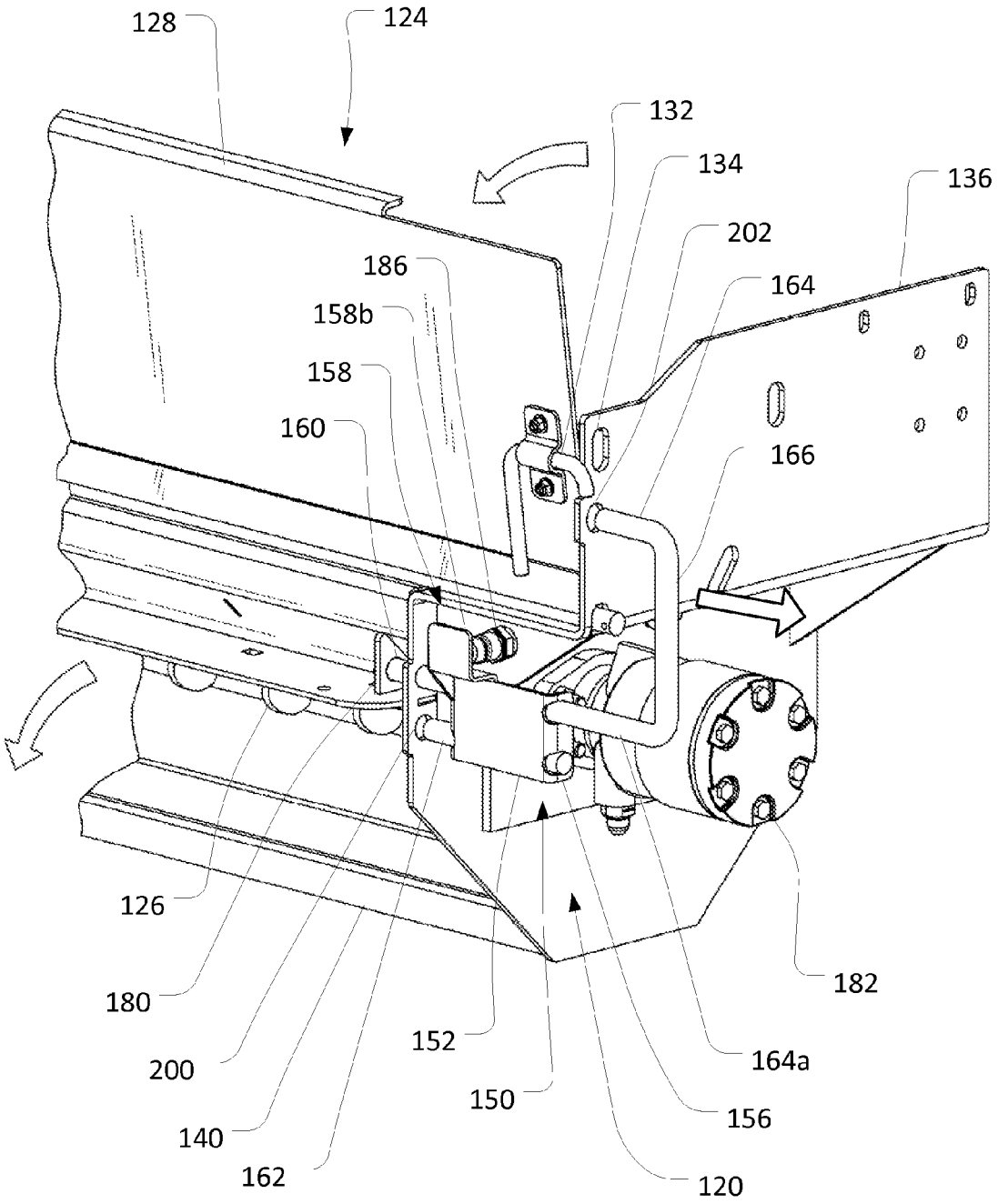
FIG. 8 is an enlarged rear, right perspective of the auger system and interlock arrangement of FIG. 6, with the interlock arrangement in an open orientation.

An upper gate 128 for the auger 126 can be configured to pivot about a pivot 130, such that the upper gate 128 can be manually moved between various orientations. For example, the upper gate 128 can be moved to a upright, closed orientation, as depicted in FIG. 6, as well as to a laid-down, closed orientation (not shown). The upper gate 128 can also be moved to an open orientation, as depicted in FIG. 8, in which the upper gate 128 can permit access to the auger 126 from the rear of the vehicle.

A lower gate 140 for the auger 126 can also be configured to pivot between various orientations. For example, the lower gate 140 can be moved to a closed orientation, as depicted in FIG. 6, as well as to an open orientation, as depicted in FIG. 8.

Referring also to FIGS. 7A and 7B, an interlock body 150 for the interlock arrangement 120 can include an interlock member such as a contoured metal cover plate 152. The cover plate 152 can include a front face 154, with side flanges 156 extending away from the front face 154 at either side of the front face 154. (It will be noted that the interlock body 150 can be installed in the interlock arrangement 120 with the front face 154 facing rearwards, relative to the vehicle.) The flanges 156 can be integrally formed with the cover plate 152, or can be otherwise secured to cover plate 152.

The interlock body 150 can also include a blocking feature, such as a blocking projection 158, secured to the cover plate 152. The blocking projection 158 can be integrally formed with the cover plate 152, or can be otherwise secured to the cover plate 152 (e.g., via welding). As depicted, the blocking projection 158 includes a spacing portion 158*a* extending generally perpendicularly away from the front face 154, with a blocking portion 158*b* extending generally perpendicularly away from the spacing portion 158*a* and generally in parallel with the front face 154. Also as depicted, the blocking projection 158 is strengthened by the inclusion of a gusset 148 between the blocking projection 158 and the front face 154 of the cover plate 152. Of note, the blocking projection 158 is configured to extend upwardly from the cover plate 152, in contrast to the downwardly extending blocking projection 58 (see, e.g., FIGS. 4A and 4B). In other embodiments, other configurations for a blocking projection, or blocking feature generally, are possible. For example, a blocking projection can otherwise extend in a variety of other directions.

The interlock body 150 can also include a guide feature, such as a guide pin 160, and various locking features, such as upper and lower locking pins 162 and 164. The guide pin 160 and locking pins 162 and 164 (or other guide or locking features) can be secured to the interlock body 150 in various ways. In the embodiment depicted, for example, the guide pin 160 and the lower locking pin 162 extend through and are secured (e.g., welded) to one of the side flanges 156, while the lower locking pin 162 and an extension 164*a* of the upper locking pin 164 extend through and are secured to the other of the side flanges 156. Also in the embodiment depicted, the guide pin 160 is integrally formed with the upper locking pin 164 in order to form a handle portion 166. In other embodiments, other handles (or no handles) can be included. Likewise, in other embodiments, the various guide and locking pins 160, 162, and 164 can be integrally formed with, or otherwise attached to, each other in various ways or not at all. A hole 168 for a cotter pin (not shown) or other device to secure the guide pin 160 with respect to the system 122 can also be included. In other embodiments, other configurations of the various guide and locking features are possible, including, for example, guide features for the interlock body 150 that are configured to engage corresponding guide tracks (or other guide features) secured to the salt-distributing system 122.

Referring again to FIG. 6, the interlock body 150 can be secured to the salt-distributing system 122 with the guide pin 160 extending through a guide hole 180*a* of a guide gusset 180. In this way, as also discussed below, the interlock body 150 can be moved between open and closed orientations, as guided by sliding movement of the guide pin 160 within the guide gusset 180. In other embodiments, other means of securing the interlock body 150 to the salt-distributing system 122 can be used, as can other means of guiding movement of the interlock body 150. For example, a track (not shown) can be provided on the salt-distributing system 122, with the interlock body 150 configured to engage and slide along the track between open and closed orientations.

Still referring to FIG. 6, the salt-distributing system 122 can further include a motor 182 (see FIG. 3), configured to power rotation of the auger 126. As depicted, the motor 182 is configured as a hydraulic motor, which can be powered by pressurized hydraulic fluid received via a hydraulic power conduit 184. In order to transmit the pressurized fluid to the motor 182, the power conduit 184 can be connected to a hydraulic power connection 186 (e.g., a quick-connect hydraulic fitting). Conversely, when the power conduit 184 is disconnected from the power connection 186, hydraulic fluid cannot flow from the power conduit 184 to the motor 182 and the motor cannot operate (at least using power from the power conduit 184).

In some embodiments, other types of motors or power sources can be used. For example, a motor for the auger 126 can be configured as an electrical motor, which may operate using electrical power received from an electrical power conduit (e.g., configured similarly to the hydraulic power conduit 184). In such a case, an appropriate (e.g., alternative) power connection to the power connection 186 can be used. For example, a quick-connect (or other) electrical connection may be provided, such that the electrical motor can operate when the relevant power conduit is connected to the electrical connection, but cannot operate (at least with power from the power conduit) when the power conduit is disconnected from the electrical connection.

In the embodiment depicted in FIG. 6, no transmission assembly is provided, as may, for example, convert one speed of rotation from an output of the motor 182 to another speed of rotation at the auger 126. In some embodiments, a transmission assembly configured as a chain drive (e.g., similar to the chain drive 88), a gear box, or otherwise can be used with the motor 182 and the auger 126.

When the interlock arrangement 120 is in a closed orientation, the interlock body 150 can prevent the upper and lower gates 128 and 140 and the shield 190 from opening, such that access to the trough 124 and the auger 126 (not shown in FIG. 6) can be obstructed. When the interlock arrangement 120 is in the closed orientation, the blocking portion 158*b* of the blocking projection 158 is disposed out of blocking alignment with the power connection 186. Accordingly, the blocking projection 158 does not prevent an operator from connecting the power conduit 184 to the power connection 186 and thereby powering the motor 182 (not shown in FIG. 15A) and the auger 126. With the blocking projection 158 thus disposed, the lower locking pin 162 extends through a lower locking hole 200, such that the locking pin 162 blocks the lower gate 128 from pivoting outward and downward to open. Further, the upper locking pin 164 extends through an upper locking hole 202, such that the upper locking pin 164 blocks the upper gate from pivoting outward and downward to open. Accordingly, with the blocking projection 158 disposed to allow the power to flow from the power conduit 184 through the power connection 186 to the motor 182, the locking pins 162 and 164 can prevent the gates 140 and 128 from opening, and thereby obstruct access to the powered auger 126 by an operator.

In order for an operator to access the auger 126 and other internal components, the operator can move the interlock arrangement 120 from the closed orientation depicted in FIG. 6 to the open orientation depicted in FIG. 8. As illustrated by a block arrow, for example, the operator may use the handle 166 to move the move the interlock body 150 generally to the right (as depicted in FIG. 8), as guided by the movement of the guide pin 160 within the guide gusset 180. In some embodiments, a stop feature, such as a cotter pin (not shown) inserted through the hole 168) or another component, can prevent the guide pin 160 from being fully withdrawn from the guide gusset 180 or can otherwise define a limit to the movement of the interlock body 150. With the interlock body 150 moved appropriately far to the right (as depicted), the locking pins 162 and 164 can be withdrawn from (or at least translated sufficiently within) the respective locking holes 200 and 202, such that the locking pins 162 and 164 no longer prevent the lower and upper gates 140 and 128 from pivoting open (as also illustrated by block arrows).

At the same time, the movement of the interlock body 150 to release the gates 140 and 128 and the shield 190 can also move the blocking portion 158*b* of the blocking projection 158 into blocking alignment with the power connection 186. Where, as depicted, the power conduit 184 (not shown in FIG. 8) has been detached from the power connection 186, the blocking projection 158 can be moved fully into blocking alignment with the power connection 186 to generally block re-attachment of the power conduit 184 to the power connection 186. Accordingly, so long as the locking pins 162 and 164 do not prevent the opening of the gates 140 and 128, the power conduit 184 cannot be re-attached to the power connection and the motor 182 (not shown in FIG. 8) and the auger 126 cannot be powered via power from the power conduit 184. Further, if the power conduit 184 is still attached to the power connection 186 when an operator attempts to move the interlock arrangement 120 from the closed orientation to the open orientation, the power conduit 184 can block movement of interlock body 150 into blocking alignment, via interaction of the power conduit 184 with the blocking projection 158, such that the gates 140 and 128 and the shield 190 cannot be opened.

The previous description of the disclosed embodiments is provided to enable any person skilled in the art to make or use the invention. Various modifications to these embodiments will be readily apparent to those skilled in the art, and the generic principles defined herein may be applied to other embodiments without departing from the spirit or scope of the invention. Thus, the invention is not intended to be limited to the embodiments shown herein but is to be accorded the widest scope consistent with the principles and novel features disclosed herein.

The invention claimed is:

1. An interlock arrangement for a vehicle with a frame, a power connection in communication with a motor, a powered device configured to be powered by the motor and at least partly enclosed by a first gate, and a power conduit, the power conduit being configured to attach to the power connection to power the motor for powering of the powered device, and the power conduit being configured to detach from the power connection to prevent powering of the motor via the power conduit, the interlock arrangement comprising:

a blocking feature;

a first locking feature; and an interlock member secured to the blocking feature and the first locking feature, the interlock member being configured to slide between first and second interlock orientations;

the blocking feature, when the interlock member is in the first interlock orientation, preventing attachment of the power conduit to the power connection, such that the motor is not enabled to power the powered device;

the first locking feature, when the interlock member is in the first interlock orientation, allowing the first gate to open in order to provide access to the powered device;

the blocking feature, when the interlock member is in the second interlock orientation, allowing attachment of the power conduit to the power connection, such that the motor is enabled to power the powered device; and the first locking feature, when the interlock member is in the second interlock orientation, preventing the first gate from opening, such that the first gate obstructs access to the powered device.

2. The interlock arrangement of claim 1, wherein a guide feature secured to the frame includes one or more of a guide bushing and a guide gusset, the interlock arrangement further comprising:

a guide pin secured to the interlock member and configured to be slidably received by the guide feature, such that the sliding of the interlock member between the first and second interlock orientations is at least partly guided by the guide feature via the guide pin.

3. The interlock arrangement of claim 1, wherein the interlock member includes a cover plate.

4. The interlock arrangement of claim 3, wherein the blocking feature includes a projection extending away from the cover plate.

5. The interlock arrangement of claim 3, wherein the motor powers the powered device via a gearbox, the interlock arrangement further comprising:

an opening in the cover plate configured to provide clearance for the gearbox as the interlock member is slid between the first and second interlock orientations.

6. The interlock arrangement of claim 1, wherein the first locking feature includes a first locking pin secured to the interlock member.

7. The interlock arrangement of claim 6, wherein a guide feature is secured to the frame, the interlock arrangement further comprising:

a guide pin secured to the interlock member and configured to be guided by the guide feature in order to guide the sliding of the interlock member between the first and second interlock orientations.

8. The interlock arrangement of claim 7, wherein the guide pin is integrally formed with the first locking pin.

9. The interlock arrangement of claim 1, wherein the vehicle further includes a second gate at least partly enclosing the powered device, the interlock arrangement further comprising:

a second locking feature secured to the interlock member;

the second locking feature, when the interlock member is in the first interlock orientation, allowing the second gate to open to provide access to the powered device; and the second locking feature, when the interlock member is in the second interlock orientation, preventing the second gate from opening, such that the second gate further obstructs access to the powered device.

10. The interlock arrangement of claim 9, wherein the interlock member includes a cover plate, the first locking feature includes a first locking pin secured to the cover plate, and the second locking feature includes a second locking pin secured to the cover plate.

11. The interlock arrangement of claim 1, wherein the vehicle further includes a shield for one or more of the motor and a transmission assembly for the motor, the shield being configured to move between an open shield orientation allowing access to the one or more of the motor and the transmission assembly and a closed shield orientation obstructing access to the one or more of the motor and the transmission assembly;

wherein, when the interlock member is in the first interlock orientation, the interlock member allows the shield to move between the closed shield orientation and the open shield orientation; and wherein, when the interlock member is in the second interlock orientation and the shield is in the closed shield orientation, the interlock member engages the shield to prevent movement of the shield from the closed shield orientation to the open shield orientation.

12. The interlock arrangement of claim 1, wherein the powered device includes an auger.

13. An interlock arrangement for a vehicle with a frame, a first guide feature secured to the frame, a power connection in communication with a motor, a powered device at least partly enclosed by first and second gates, and a power conduit, the power conduit being configured to attach to the power connection to power the motor and thereby power the powered device, and the power conduit configured to detach from the power connection to prevent powering of the motor via the power conduit, the interlock arrangement comprising:

an interlock body including a cover plate, a blocking feature secured to the cover plate, first and second locking pins secured to the cover plate, and a second guide feature secured to the cover plate and engaging the first guide feature, the interlock body being configured to move between first and second interlock orientations, as guided by the first and second guide features;

the blocking feature, when the interlock body is in the first interlock orientation, preventing attachment of the power conduit to the power connection, such that the motor is not enabled to power the powered device with power received via the power conduit;

the first and second locking pins, when the interlock body is in the first interlock orientation, allowing the first and second gates, respectively, to open in order to provide access to the powered device;

the blocking feature, when the interlock body is in the second interlock orientation, allowing attachment of the power conduit to the power connection, such that the motor is enabled to power the powered device with power received via the power conduit; and the first and second locking pins, when the interlock body is in the second interlock orientation, preventing the first and second gates, respectively, from opening, such that the first and second gates obstruct access to the powered device.

14. The interlock arrangement of claim 13, wherein the blocking feature includes a projection extending away from the cover plate.

15. The interlock arrangement of claim 13, wherein the motor powers the powered device via a gearbox, the interlock arrangement further comprising:

an opening in the cover plate configured to provide clearance for the gearbox as the interlock body is moved between the first and second interlock orientations.

16. The interlock arrangement of claim 13, wherein the vehicle further includes a transmission assembly for conveying power from the motor to the powered device, and a shield for one or more of the motor and the transmission assembly, the shield being configured to move between an open shield orientation allowing access to the one or more of the motor and the transmission assembly and a closed shield orientation obstructing access to the one or more of the motor and the transmission assembly;

wherein, when the interlock body is in the first interlock orientation, the interlock body allows the shield to move between the closed shield orientation and the open shield orientation; and wherein, when the interlock body is in the second interlock orientation and the shield is in the closed shield orientation, the interlock body engages the shield to prevent movement of the shield from the closed shield orientation to the open shield orientation.

17. An interlock arrangement for a vehicle with a frame, a guide feature secured to the frame and including a guide hole, a power connection in communication with a motor, a powered auger at least partly enclosed by first and second gates, and a power conduit, the power conduit being configured to attach to the power connection to power the motor and thereby power rotation of the powered auger, and the power conduit being configured to detach from the power connection to prevent powering of the motor via the power conduit, the interlock arrangement comprising:

an interlock body including a cover plate, a blocking projection secured to and extending away from the cover plate, first and second locking pins secured to the cover plate, and a guide pin secured to the cover plate and extending at least partly through the guide hole, the interlock body being configured to move between first and second interlock orientations, as guided by movement of the guide pin within the guide hole;

the blocking projection, when the interlock body is in the first interlock orientation, being in blocking alignment with the power connection to prevent attachment of the power conduit to the power connection, such that the motor is not enabled to power the rotation of the powered auger with power received via the power conduit;

the first and second locking pins, when the interlock body is in the first interlock orientation, allowing the first and second gates, respectively, to open in order to provide access to the powered auger;

the blocking projection, when the interlock body is in the second interlock orientation, being out of blocking alignment with the power connection in order to allow attachment of the power conduit to the power connection, such that the motor is enabled to power the rotation of the powered auger with power received via the power conduit; and the first and second locking pins, when the interlock body is in the second interlock orientation, physically obstructing the first and second gates, respectively, to prevent the first and second gates from opening, such that the first and second gates obstruct access to the powered auger.

18. The interlock arrangement of claim 17, wherein the guide pin is integrally formed with the first locking pin.

19. The interlock arrangement of claim 18, wherein the integrally formed guide pin and first locking pin provide a handle for manual movement of the interlock body between the first and second interlock orientations.

20. The interlock arrangement of claim 17, wherein the cover plate includes an opening and a removable cover for opening.

* * * * *